US012022925B2

(12) United States Patent
Armstrong

(10) Patent No.: US 12,022,925 B2
(45) Date of Patent: Jul. 2, 2024

(54) CASE FOR AN ELECTRONIC DEVICE

(71) Applicant: Urban Armor Gear, LLC, Laguna Niguel, CA (US)

(72) Inventor: Steven Armstrong, Laguna Niguel, CA (US)

(73) Assignee: Urban Armor Gear, LLC, Laguna Niguel, CA (US)

( * ) Notice: Subject to any disclaimer, the term of this patent is extended or adjusted under 35 U.S.C. 154(b) by 695 days.

(21) Appl. No.: 16/612,324

(22) PCT Filed: Sep. 15, 2017

(86) PCT No.: PCT/US2017/051855

§ 371 (c)(1),
(2) Date: Nov. 8, 2019

(87) PCT Pub. No.: WO2018/053311

PCT Pub. Date: Mar. 22, 2018

(65) Prior Publication Data

US 2020/0093236 A1 Mar. 26, 2020

Related U.S. Application Data

(60) Provisional application No. 62/395,831, filed on Sep. 16, 2016.

(51) Int. Cl.
*A45C 11/00* (2006.01)

(52) U.S. Cl.
CPC ..... *A45C 11/00* (2013.01); *A45C 2011/002* (2013.01); *A45C 2011/003* (2013.01)

(58) Field of Classification Search
CPC ..... A45C 11/00; A45C 2011/001; A45C 2011/002; A45C 2011/003
See application file for complete search history.

(56) References Cited

U.S. PATENT DOCUMENTS

| | | | | |
|---|---|---|---|---|
| 9,419,669 | B2 * | 8/2016 | Smith | G05G 1/02 |
| 9,876,522 | B2 * | 1/2018 | Huang | H04B 1/3888 |
| 10,051,934 | B1 * | 8/2018 | Zhang | A45C 11/00 |
| 10,541,714 | B2 * | 1/2020 | Mody | H04M 1/0283 |
| 11,064,061 | B2 * | 7/2021 | Zeng | H05K 5/0217 |
| 2014/0069825 | A1 * | 3/2014 | Macrina | A45C 11/00 206/37 |
| 2015/0111623 | A1 * | 4/2015 | Hegemier | B44C 1/105 455/575.1 |

(Continued)

FOREIGN PATENT DOCUMENTS

| | | | |
|---|---|---|---|
| CN | 102184001 | A | 9/2011 |
| CN | 202774742 | U | 3/2013 |

(Continued)

OTHER PUBLICATIONS

Written Opinion and International Search Report for PCT/US2017/051855, dated Jan. 18, 2018.

(Continued)

*Primary Examiner* — Derek J Battisti
(74) *Attorney, Agent, or Firm* — Neal, Gerber & Eisenberg LLP

(57) ABSTRACT

A sandwich construction, integrated multi-layered case for an electronic device is provided herein, including methods of production and protecting an electronic device.

32 Claims, 5 Drawing Sheets

(56) References Cited

U.S. PATENT DOCUMENTS

2016/0029760 A1* 2/2016 Park ..... A45C 11/00
224/242

FOREIGN PATENT DOCUMENTS

| | | | |
|---|---|---|---|
| CN | 104903215 | A | 9/2015 |
| EP | 3512371 | | 7/2019 |
| JP | 2019533346 | A | 11/2019 |
| WO | 2018053311 | A1 | 3/2018 |

OTHER PUBLICATIONS

"Communication pursuant to Rules 161(2) and 162 EPC Of EP Application No. 17851637.3 dated Apr. 19, 2019, 3 Pages".
"Communication pursuant to Rules 70(2) and 70a(2) EPC received for EP Application No. 17851637.3 dated Mar. 17, 2020".
Extended European Search Report received in EP Application No. 17851637.3 dated Feb. 26, 2020, 7 pages.
"International Preliminary Report on Patentability dated Mar. 28, 2019 in PCT Application No. PCT/US2017/051855".
Canadian Office Action for Canadian Patent Application No. 3,036,569 dated Nov. 24, 2022 (5 pages).

* cited by examiner

CASE FOR AN ELECTRONIC DEVICE

CROSS-REFERENCE TO RELATED APPLICATION

This application is a U.S. national phase application of International Patent Application Serial No. PCT/US2017/051855, filed Sep. 15, 2017, which claims priority to and benefit under 35 U.S.C § 119(e) of U.S. Provisional Patent Application Ser. No. 62/395,831, filed Sep. 16, 2016, the contents of which are hereby incorporated by reference in their entirety as if fully set forth below.

FIELD

This disclosure relates generally to protective cases for portable electronic devices and more particularly, protective cases for electronic devices such as smart phones, tablets, PDAs, and laptops.

BACKGROUND

With increasing regularity, protective cases are being constructed for a variety of computing devices such as smart phones, tablets, PDAs and/or other portable computing devices. Their respective designs vary, ranging between degrees of protection as well as facilitating use of the computing device in a more protected environment.

Cases have been known to be constructed from molding using silicon or thermoplastic polyurethane rubber that provides some basic protection against drops and scratches. Other case designs have been constructed from substantially rigid injected plastics such as polycarbonate. The design and construction of the known cases therefore vary depending on the desired amount of protection, costs, and consideration for certain materials and mounting schemes balanced with features that facilitate performance of the computing device itself. For example, a certain material may provide basic structural protection and be relatively cheap, but this material may induce too much friction (e.g. grip) to the user that interferes with easy attachment of the case with the device or grip with other articles such as parts of the user's body or other objects foreign to the case.

Cases can also suffer from being too bulky and difficult to stow away. It is also known that materials for certain cases can degrade over time thereby diminishing protective capabilities of the case as well as loosening its attachment with the computing device. Aesthetically, a worn case also diminishes the overall impression of the case and the attached computing device. Such cases can also have reduced bulk versus their rubber counterparts and be difficult to carry around. This is particularly problematic when with bulky cases where the end-user may have to decide, for example, between carrying the electronic device or their wallet. Additionally, plastic injected mold cases can suffer from passing on relatively high material stresses to the electronic device itself due to the differing elasticity and cushioning. For such devices with sensitive displays or input mediums, such protection therefore may not be desirous.

Yet, stress tests to the computing devices used with known solutions caused by normal use through drops or collisions can lead to device damage and case separation. In turn, the user may have to fix the device, buy a new one, and/or re-assemble the case. Therefore, a need exists to resolve these and other problems in the art.

SUMMARY

The following simplified summary is provided in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later. Though described in a series of embodiments, the various features of the various embodiments may be combined in manners described herein. For example, a feature, connection, or material type may be substituted for another described feature, connection, or material type for a specific aspect of the interconnected walls, shear plate, backing material, and/or frame according to the present disclosure such that the specific complete embodiments described herein are merely exemplary only.

In certain embodiments, a multi-layered composite case for an electronic device is provided, the case comprising: an electronic device cradle defined by two or more interconnected walls and a base operably connected with the two or more inter-connected walls; a shear plate of substantially rigid material, the shear plate forming at least a first portion of the base; a frame of substantially rigid material operatively connected with the shear plate and forming at least a second portion of the base; and a backing layer of material having a different rigidity than the shear plate or the frame, wherein the backing layer is positioned between the shear plate and the frame and forms at least a third portion of the base, wherein the two or more inter-connected walls are comprised of a resilient and impact resistant material, and wherein the electronic device cradle is adapted to house the electronic device in a predetermined orientation with, when housed, the two or more inter-connected walls adjacent to at least a portion of a perimetral portion of the device and the base adjacent to a back of the device. In the most frequent embodiments, wherein the electronic device comprises a screen portion, the back portion, and the perimetral portions, wherein the screen portion and the back portion are situated on opposite sides of the device.

In certain embodiments, the two or more inter-connected walls are comprised of less rigid material than the shear plate or frame. In often included embodiments, the two or more walls comprise four walls interconnected at right angles.

In frequent embodiments, the backing layer, shear plate and frame together form a multi-layer sandwich construction. Often the shear plate and the frame comprise the same material. Also often, the shear plate and the frame comprise materials having different rigidities. In certain frequently included embodiments, the backing layer comprises a material having different rigidity than the two or more interconnected walls. In frequent embodiments, the two or more inter-connected walls, the shear plate, and the backing material comprise different materials having different rigidities, resiliency, modulus of elasticity, or impact resistance. Also in frequent embodiments, the two or more interconnected walls, the shear plate, the frame, and the backing material comprise different materials having different rigidities, resiliency, modulus of elasticity, or impact resistance.

In certain frequent embodiments, the backing material, frame, or shear plate wraps at least partially around the perimetral portion of the electronic device, when housed in the electronic device cradle.

In more frequent embodiments, the backing material, frame, or shear plate does not wrap at least partially around the perimetral portion of the electronic device, when housed in the electronic device cradle. In often included embodiments, the backing material, frame, and shear plate do not wrap at least partially around the perimetral portion of the electronic device, when housed in the electronic device cradle. In frequent embodiments, the two or more inter-connected walls wrap at least partially around the perimetral portion of the electronic device, when housed in the electronic device cradle. In less frequent embodiments, the two or more inter-connected walls do not wrap at least partially around the perimetral portion of the electronic device, when housed in the electronic device cradle. In certain embodiments, at least one of the two or more inter-connected walls does not wrap at least partially around the perimetral portion of the electronic device, when housed in the electronic device cradle. Also in certain embodiments, a plurality of the two or more inter-connected walls do not wrap at least partially around the perimetral portion of the electronic device, when housed in the electronic device cradle.

In frequent embodiments, at least one of the two or more inter-connected walls comprises portion adapted to access a port, a button, a dock, a lever, a knob, a speaker, or an opening on the device, when housed in the electronic device cradle.

In frequent embodiments, the substantially rigid material comprises a thermoset polymer or a thermoplastic polymer. Often the thermoplastic polymer comprises polycarbonate plastic.

Frequently in each of the presently described embodiments, the shear plate, the backing material, and the frame are fit together in a structural mating geometry, or sandwich orientation of materials as described herein. Often, the structural mating geometry comprises a first indentation, a groove, an independent member, or a raised portion on the shear plate or the backing material adapted to mate with a corresponding structure on the frame. Also often, the structural mating geometry comprises a first indentation, a groove, an independent member, or a raised portion on the shear plate adapted to mate with a corresponding structure on the backing material or the frame. In certain embodiments, the structural mating geometry comprises a first indentation, a groove, an independent member, or a raised portion on the shear plate or the frame adapted to mate with a corresponding structure on the backing material. In certain embodiments, the two or more inter-connected walls and the shear plate are fit together in a structural mating geometry. Also in certain embodiments, the two or more inter-connected walls and the frame are fit together in a structural mating geometry. In certain embodiments, the two or more inter-connected walls and the backing material are fit together in a structural mating geometry.

In frequent embodiments, the shear plate is adapted to cover less than the entire back of the device. Also in frequent embodiments, the frame is adapted to cover a periphery region of the shear plate adjacent to the two or more inter-connected walls.

Frequently, the electronic device cradle is adapted to provide an unobstructed opening or a window for an optical device of the electronic device. Often, the base is fit together in a structural mating geometry with the two or more inter-connected walls.

Often, the resilient and impact resistant material comprises thermoplastic polyurethane. Also often, the two or more walls comprise thermoplastic polyurethane rubber and the shear plate comprises a polycarbonate. Frequently, the two or more walls comprise thermoplastic polyurethane rubber and the frame comprises a polycarbonate.

Frequently according to the presently described embodiments, the backing material comprises leather. Often, the leather comprises a full-grain, a top-grain, a corrected-grain, or a split grain leather. Also, often the backing material comprises wood, wood pulp, or wood fiber. In certain embodiments, the backing material comprises carbon fiber. Also in certain embodiments, the backing material comprises a woven fabric or non-woven fabric, such as a natural fiber fabric or a synthetic textile or synthetic fiber fabric. In embodiments include a natural fiber fabric, the natural fiber often comprises cotton fiber, alpaca, camel, coir, flax, jute, ramie, sisal, abaca, angora, cashmere, hemp, mohair, silk, or wool, or blends of two or more of these fibers. In certain embodiments, the backing material comprises a natural fiber fabric but not a synthetic fiber fabric. In certain embodiments, a blend of natural and synthetic fibers is included.

In similarly included embodiments, a method of assembling a multi-layered composite case described herein is provided comprising connecting the two or more interconnected walls with the shear plate; and arranging the backing material between the shear plate and the frame and assembling the frame with the two or more inter-connected walls or shear plate, thereby forming a multi-layer sandwich between at least the shear plate, the backing material, and the frame.

A variety of methods and systems of utilizing, manufacturing, and/or assembling the disclosed case is also contemplated in a variety of situations and environments. To the accomplishment of the foregoing and related ends, certain illustrative aspects are described herein in connection with the following description and the annexed drawings. These aspects are indicative, however, of but a few of the various ways in which the principles of the claimed subject matter may be employed and the claimed subject matter is intended to include all such aspects and their equivalents. Other advantages and novel features may become apparent from the following detailed description when considered in conjunction with the drawings.

DETAILED DESCRIPTION

Figure 1:
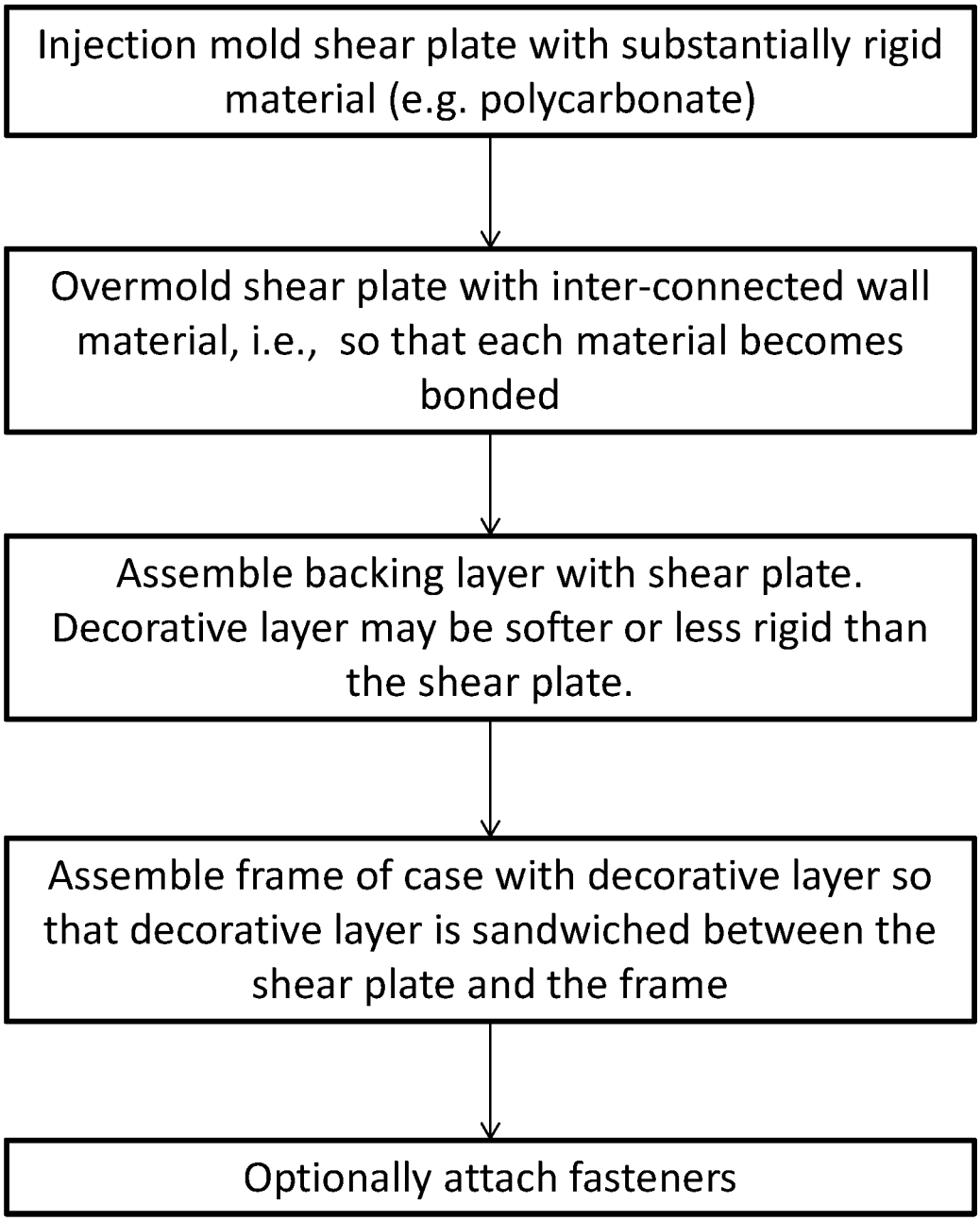
FIG. 1 depicts an exemplary schematic overview of one method of assembling a case as shown and described herein.

The features of the presently disclosed solution may be economically molded or assembled by using one or more distinct parts and associated components which, may be assembled together for removable or integral application with a known or to-be-designed computing device case in an economical manner, wherein the features of the present disclosure may form the herein disclosed servicing apparatus regardless of the particular form. Unless defined otherwise, all terms of art, notations and other scientific terms or terminology used herein have the same meaning as is commonly understood by one of ordinary skill in the art to which this disclosure belongs.

Terms with commonly understood meanings may be defined herein for clarity and/or for ready reference, and the inclusion of such definitions herein should not necessarily be construed to represent a substantial difference over what is generally understood in the art. All patents, applications, published applications and other publications referred to herein are incorporated by reference in their entirety. If a definition set forth in this section is contrary to or otherwise inconsistent with a definition set forth in the patents, application, published applications and other publications that are herein incorporated by reference, the definition set forth in this section prevails over the definition that is incorporated herein by reference.

As used herein, "a" or "an" means "at least one" or "one or more." As used herein, the term "user", "subject", "end-user" or the like is not limited to a specific entity or person. For example, the term "user" may refer to a person who uses the systems and methods described herein, and frequently may be a technician. However, this term is not limited to end users or technicians and thus encompasses a variety of persons who can use the disclosed systems and methods.

The disclosed solution can now be better understood turning to the following detailed description. It is to be expressly understood that the illustrated embodiments are set forth as examples and not by way of limitations on the embodiments as ultimately defined in the claims. An embodiment in accordance with the present disclosure provides a cover for a computing device such as a laptop, a smart phone, a tablet or any other portable computing device. The case can be made of multiple parts, integrally formed therewith or detachable.

It is understood that "electronic device" can mean any computing device such as a laptop, a smart phone, a tablet computing device, PDAs or the like.

"Shield" as used herein with the disclosed case can mean to protect, wrap around, or envelope a corresponding computing device in a manner that conceals the computing device from: injuries during a drop or accident such as by impact or collision; scrapes and scratches during or between uses; and/or other injuries to the outer surfaces and internal mechanisms of the device.

As used herein, "impact resistance" or "impact resistant" refers to the nature of a material to remain intact, avoid permanent damage, permit deformation without breakage, rebound, protect, or the similar, in the presence of an impact force. In certain embodiments, impact resistance is measured using an elastic modulus measurement. "Impact resistant" or "impact resistance" as it relates to the herein disclosed case features can mean any feature designed to withstand applied forces or related shock across the disclosed case and any device housed therein. Accordingly, features or materials described herein as providing impact resistance or being impact resistant utilize material properties and/or structural design of the case directed towards mitigating the effects of expected events in the life-cycle of the case and corresponding computing device that incur impact (e.g. drops, collisions, accidents, etc.)

As used herein, "rigid" refers most frequently to the flexibility of a material, or in the case of a rigid material—lack of flexibility or compliance. A rigid material may be referred to herein in terms of its stiffness, hardness, firmness, flexibility, bendability, or elasticity. The rigidity of a material referred to here may be by way of comparison with another known material, the material properties of each being known or a knowable value. On occasion, the rigidity of a material may by way of a measurement such as Newtons per meter, pounds per inch, force divided by displacement produced by the force along one degree of freedom; or in the case of rotational stiffness, applied moment per rotation, Newton-meters per radian, or inch-pounds per degree. In certain embodiments, a substantially rigid or a rigid material carries a higher modulus of elasticity relative to a less rigid or a flexible material.

As used herein, the term "substantially" is intended to have a common meaning referring to a quality greater than 50%, and often is interchangeable with the term mostly, largely mainly, or fundamentally. When referring to a material property, the term "substantially" refers to a quality encompassing an absolute but with a degree of freedom that is often based on a comparison of materials of properties. For example, "substantially rigid" is intended to encompass a rigid material in addition to a material that has a minimal or known amount of flexibility relative to another material in an exemplary or claimed case.

As used herein the term "resilient" or "resiliency" is intended to refer to the hardness of a material. Hardness, and therefore resiliency, is often measured on the durometer scale or Rockwell hardness scale. Durometer measurements or Rockwell hardness measurements are contemplated manners of measuring or referring to material resiliency/hardness herein. Often a material is considered soft or more resilient having a lower durometer relative to a material having a higher durometer (which is considered harder or less resilient).

As used herein, the term "predetermined" refers to an intended or planned operation, orientation or characteristic. As such, when something is predetermined it may refer to a use, an orientation, an arrangement, a design or a method having certain basic prerequisites. For example, as used herein "predetermined" can refer to the adaptation or situation of one or more aspects of a case contemplated herein to permit the full operation of an electronic device, including operation of and/or access to the device screen, port, button, dock, lever, knob, speaker, or opening or any other external actuators or externally actuated but internally operable functionalities, and the like, when the device is housed or present within the case. In other words, the cases of the present disclosure are adapted to provide protection to an electronic device while permitting full functionality of that device when housed in the case when the device is housed properly in the case in a specific orientation. Conversely, when a device is situated in a case such that access to the screen is blocked, such an orientation is not a predetermined orientation of the device relative to the case as that term is used herein, since access to various functionalities of the device (e.g., sleep, volume, power, etc.) may be inhibited or blocked.

As used herein, the terms "front," "back," "side" or other similar terms are intended to refer to the whole of that aspect unless specifically indicated otherwise.

The herein disclosed cases and methods of use are provided to house and protect a variety of electronic devices. Most often the electronic device is a mobile device having wired or wireless data transfer and/or telephonic capability. For example, the electronic device may be a device commonly referred to as a mobile phone, though such a device may have electronic data capabilities well in excess of handling phone calls.

Some embodiments include a multi-part case made of, for example, a decorative portion, a substantially rigid portion and a chassis. The substantially rigid portion can included to subparts bonded to each other of varying materials (e.g. one part can be injection molded TPU rubber and another portion may be a molded over polycarbonate shield).

The substantially rigid portion, in some embodiments, may comprise one or more perimetral edge structures extending outwardly from an inner, planar surface or arcuate surface. The perimetral edge may be continuous or multiple individual portions with a base that protects the back of the electronic device when secured therein. Preferably, the perimetral edges of the interconnected walls can form bumpers and/or inwardly extending lips operable to flex outwardly during attachment. In this respect, the inwardly extending lip may engage with the front surface of the electronic device and provide added protection in the event of a drop or impact.

When the device is installed (i.e., housed, positioned) inside the case, the case and device are substantially coexistive through a mechanical means so that a protective system is established that provides resistance to impacts, sharp objects, shock and scratches to the device. The device generally forms a cradle between the base and the interconnected walls that is adapted to securely hold the electronic device and permit its full functionality when held. In certain embodiments, functionality may be provided through access to aspects such as removable port protectors and the like. Also in certain embodiments, access to full functionality is intended to encompass a situation where access to a sim card or another component of the device that is not generally accessed while the device is in normal operation by a user may be inhibited while the electronic device is housed in the case. The herein described solution may therefore form a protective system for the electronic device that securely retains and protects the device in most operating conditions including, but not limited to, the standards set forth by MIL-STD 810G, 516.6 while minimizing material weight and size of the case.

The backing layer of the present electronic devices forms a core component of an innovative sandwich of plurality of materials that imparts a variety of benefits on the cases described herein. While providing a unique aesthetic, the backing material imparts a unique protective quality only achievable via the combination of materials having different properties. Stiffness, resiliency, and impact resistance being a few of these properties. The blending of the resiliency and/or stiffness properties via the sandwich combination of layers provides weight savings and additional protection to an electronic device not available via a single material or even two layers of materials without the core backing layer provided herein. In certain embodiments, the backing layer is referred to as a decorative layer or layer comprised of a decorative material, which is additive to the functional and structural benefits provided via the sandwich construction described herein.

The backing layer may be comprised of a material such as leather, wood, carbon fiber, fiberglass, woven or nonwoven fabric, synthetic textile, stone, glass, or metal. Often the backing material is comprised of leather, wood of carbon fiber. In certain embodiments, the backing material is not a plastic. In certain embodiments, the backing material is not a rubber or not a rubber having a high modulus of elasticity. In certain embodiments comprising a fabric, natural fabric is utilized such as cotton fiber, alpaca, camel, coir, flax, jute, ramie, sisal, abaca, angora, cashmere, hemp, mohair, silk or wool. Non-natural or synthetic fabric or fabric fibers are chemically produced rather than naturally produced.

In certain frequent embodiments, the backing material is adapted to cover or be coextensive with the shear plate and/or the frame. In certain frequent embodiments, the backing material is adapted to cover or be coextensive with only a portion of, or be smaller than, the shear plate and/or the frame. In certain frequent embodiments, the backing material is adapted to extend beyond, or be larger than in at least a single aspect, the shear plate and/or the frame in at least one aspect (e.g., to wrap up and around the lateral interconnected walls). In certain embodiments, the backing material is adapted to be exposed to sight or touch when the frame is attached to the case. The frame attachment to the shear plate, with the backing material sandwiched between, provides a unique lightweight construction protection.

The interconnected walls are provided often as a single or contiguous material or matrix. Less frequently, the interconnected walls are assembled from multiple parts. As such, the interconnected walls form an aspect of the cradle that comprises a single wall adapted to be situated around the perimetral portion of the device. Each wall of the multiple "walls" as the term is used in the phrase "interconnected walls" refers to a wall situated at a different angle. For example, one wall maybe situated at a 90 degree angle relative to an immediately adjacent aspect of the wall and be referred to as a different wall. Stated differently, a wall intended to be adjacent to a side perimetral portion of an electronic device is a different wall than a wall intended to be adjacent to a top or bottom perimetral portion of the electronic device, even though the wall material may be contiguous.

The frame may be provided in a variety of configurations. Though not wishing to be bound by any particular theory of operation, the frame provides a slim and lightweight structural solution to add strength to the present cases without adding unnecessary bulk and preserving the sleekness of many of today's electronic devices. The frame is often comprised of a rigid or substantially rigid material (e.g., polycarbonate or another substantially rigid thermoplastic). Often the frame is provided to resistance against flexing in one or more directions (e.g., toward the open cradle or torsional flexing) and in this regard may have a relatively thin and relatively flat or slightly rounded profile. As a frame, it may have a solid core structure with one or more legs that fan out in multiple directions. The frame may alternatively have an open core structure, diffuse structure, or a non-centralized structure, when viewed from the back of the case. The frame itself is often molded or formed from a single piece of material. Alternatively, the frame is formed from multiple pieces that are assembled over the backing layer, which when assembled provide enhanced structural support and protection to the case. In either case, the frame may be provided such that it is biased to flex in one or more specific directions and resist flexing in one or more different directions. In certain embodiments, the frame is provided to resist flexing in two or more directions. This material may be the same or different than the material forming, for example, the shear plate. When utilized sandwiched together with the backing layer, shear plate and interconnected walls, the frame provides efficient support and protection where needed to shield an electronic device (e.g., when housed in the case), and flexibility when needed to permit ease of use (e.g., when inserting/removing the device to/from the case, access to device features, etc.). As depicted in the examples provided herein, the frame may be frequently situated to expose the backing layer in portions not covered by the frame. Such exposure preserves the sleekness and ease of portability of the case, without sacrificing protection or functionality in key areas of the case. The frame also enhances the gripability of the case itself as well to protect against accidental drops and to enable a variety of comfortable holding positions and orientations when the device is in use in the hand of a user. The added texture and physical features protect against impact and reduce the likelihood of the impact accidentally occurring through slippage from the hand of a user, while preserving a sleek profile that permits ease of storage in the pocket, bag, or purse of a user. The present inventors have found the depicted orientation of the frame (as described herein) in the exemplified embodiments to be particularly advantageous to provide these and other benefits.

FIG. 1 provides one exemplary molding and layup process for an exemplary case described and depicted herein. This process applies to embodiments described herein, including those depicted in FIGS. 2-5.

Figure 2:
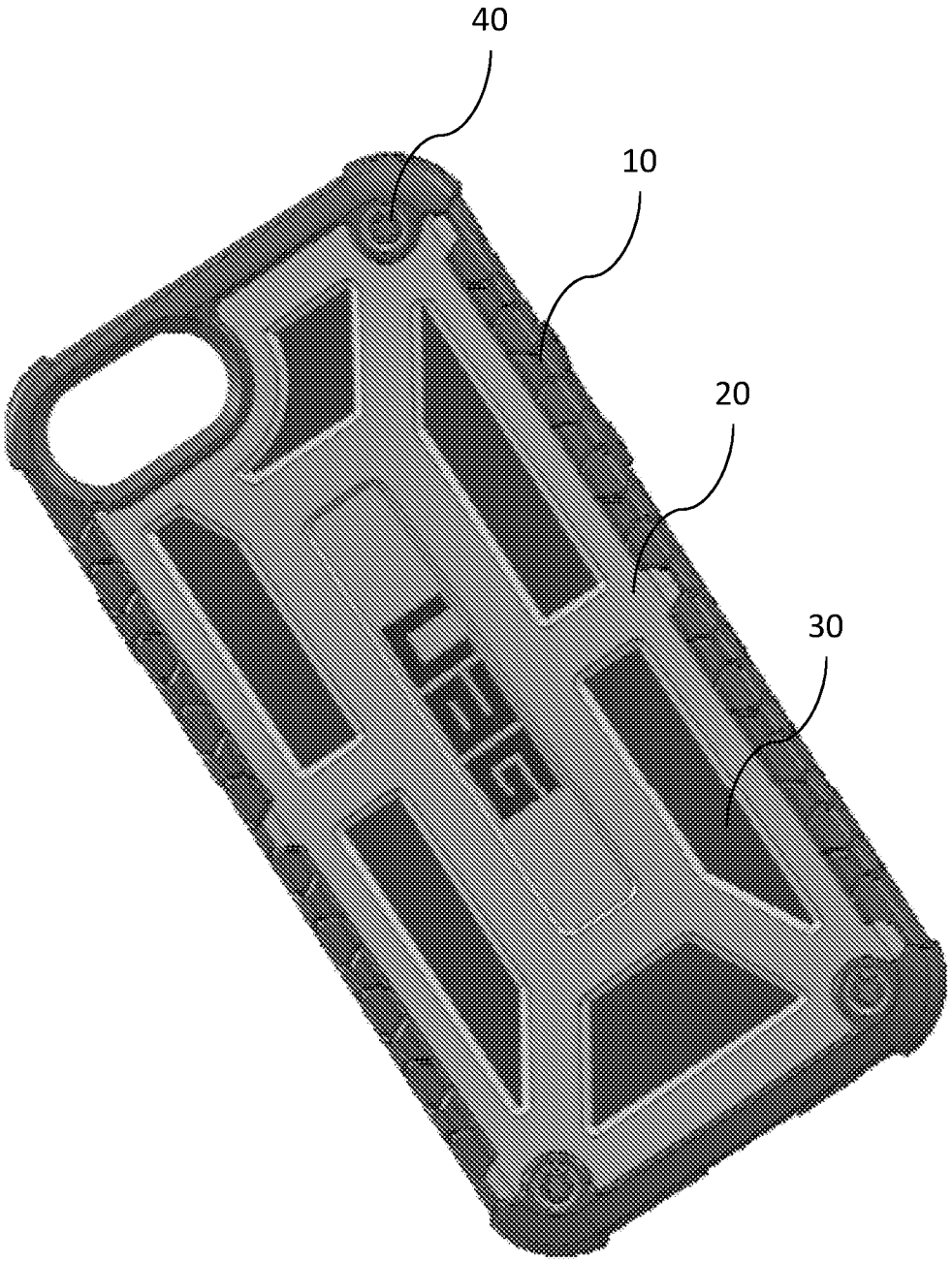
FIG. 2 depicts a rear perspective of another embodiment of an assembled case.

With regard to the embodiment depicted in FIG. 2, a multilayer (or sandwiched) configuration is depicted. In this embodiment, the shear plate is not visible. The interconnected walls (10) are seen wrapping around the periphery, in addition to the backing material (30) and the frame (20) covering a portion of the backing material (30). Fasteners (40) are also depicted. Together the backing material (30), frame (20), and shear plate comprise the base of the cradle (the opening of the cradle facing away in this Figure) surrounded by the interconnected walls (10).

Figure 3A:
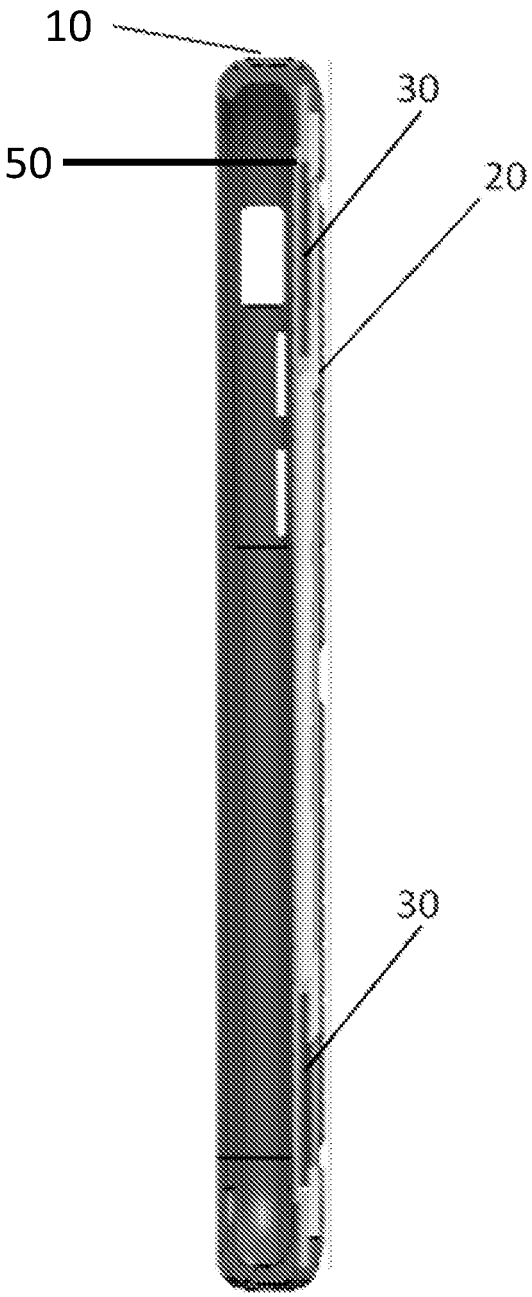
FIG. 3A depicts a cross-section view of another embodiment of the case of FIG. 2.
Figure 3B:
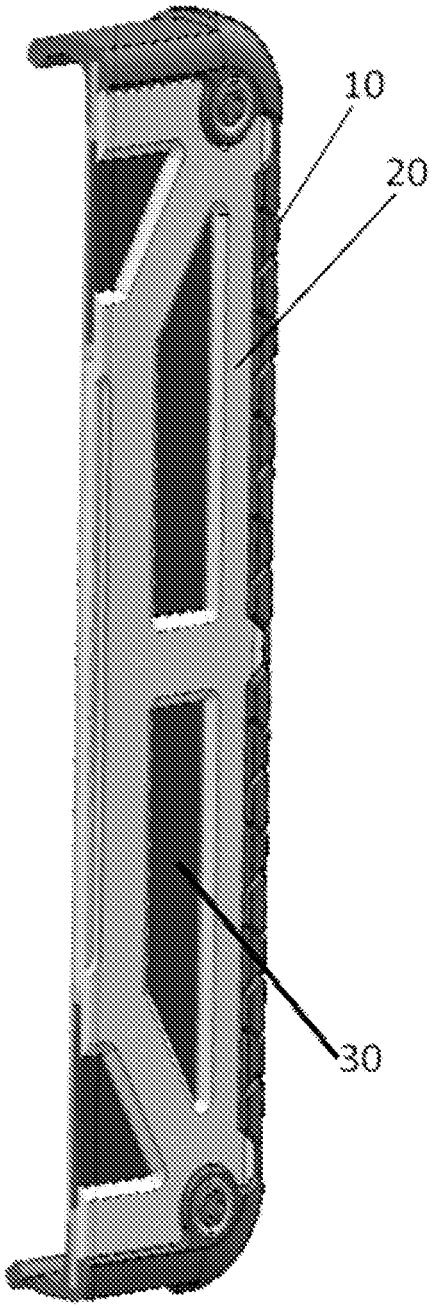
FIG. 3B depicts a profile view of the cross-section view of the case depicted in FIG. 3A.

FIGS. 3 A and 3B represent cross-sectional views of the Figure of FIG. 2. The sandwich construction can be seen in these Figures, including the shear plate (50) relative to the backing material (30) and frame (20) and interconnected walls (10).

Figure 4:
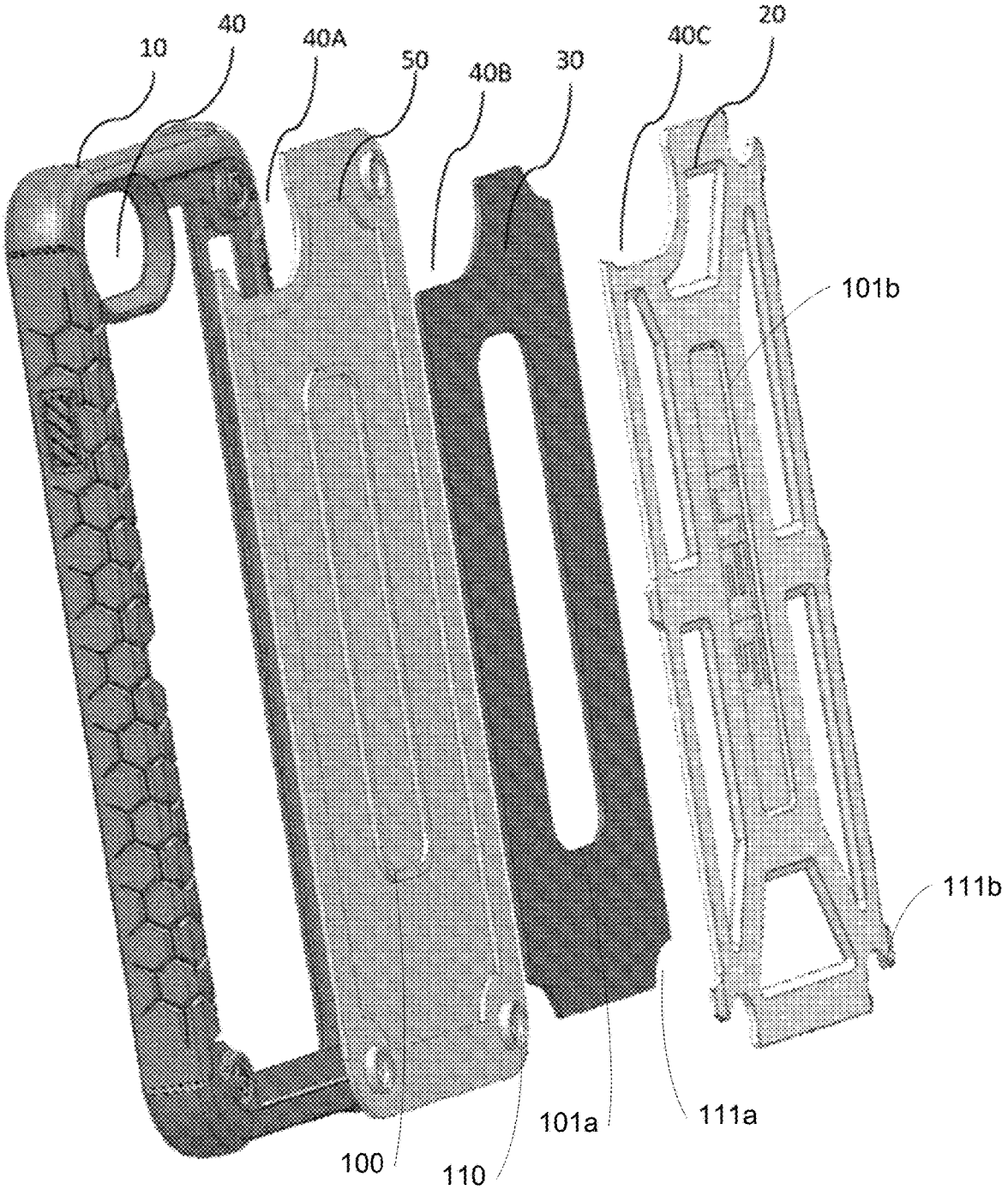
FIG. 4 depicts an exploded view of another embodiment of a case.

FIG. 4 provides a cradle base facing perspective exploded view of an exemplary device of the present disclosure. An exemplary arrangement of the interconnected walls (10), shear plate, (50), backing material (30) and frame (20) is provided. In this embodiment, an opening (40) for an optical device can be seen in the upper left portion of the material of the upper interconnected wall (10). A corresponding opening or notch can be seen in the shear plate (40A), backing material (40B) and frame (40C). While present in a specific portion of the overall case, this is merely exemplary. In certain embodiments, there is no opening (40) in the interconnected wall material.

In embodiments, the shear plate 50, the backing material 30, and the frame 20 are fit together in a structural mating geometry, or sandwich orientation of materials. Often, the structural mating geometry comprises a first indentation, a groove, an independent member, or a raised portion on the shear plate 50 or the backing material 30 adapted to mate with a corresponding structure on the frame 20. Also often, the structural mating geometry comprises a first indentation, a groove, an independent member, or a raised portion on the shear plate 50 adapted to mate with a corresponding structure on the backing material 30 or the frame 20. In certain embodiments, the structural mating geometry comprises a first indentation, a groove, an independent member, or a raised portion on the shear plate 50 or the frame 20 adapted to mate with a corresponding structure on the backing material 30. As a first non-limiting example, FIG. 4 shows a raised portion 100 on the shear plate 50 that is adapted to mate with corresponding structures 101*a* and 101*b* on the backing material 30 and the frame 20, respectively. As a second non-limiting example FIG. 4 shows a raised portion 110 that is adapted to mate with corresponding structures 111*a* and 111*b* on the backing material 30 and the frame 20, respectively.

Figure 5:
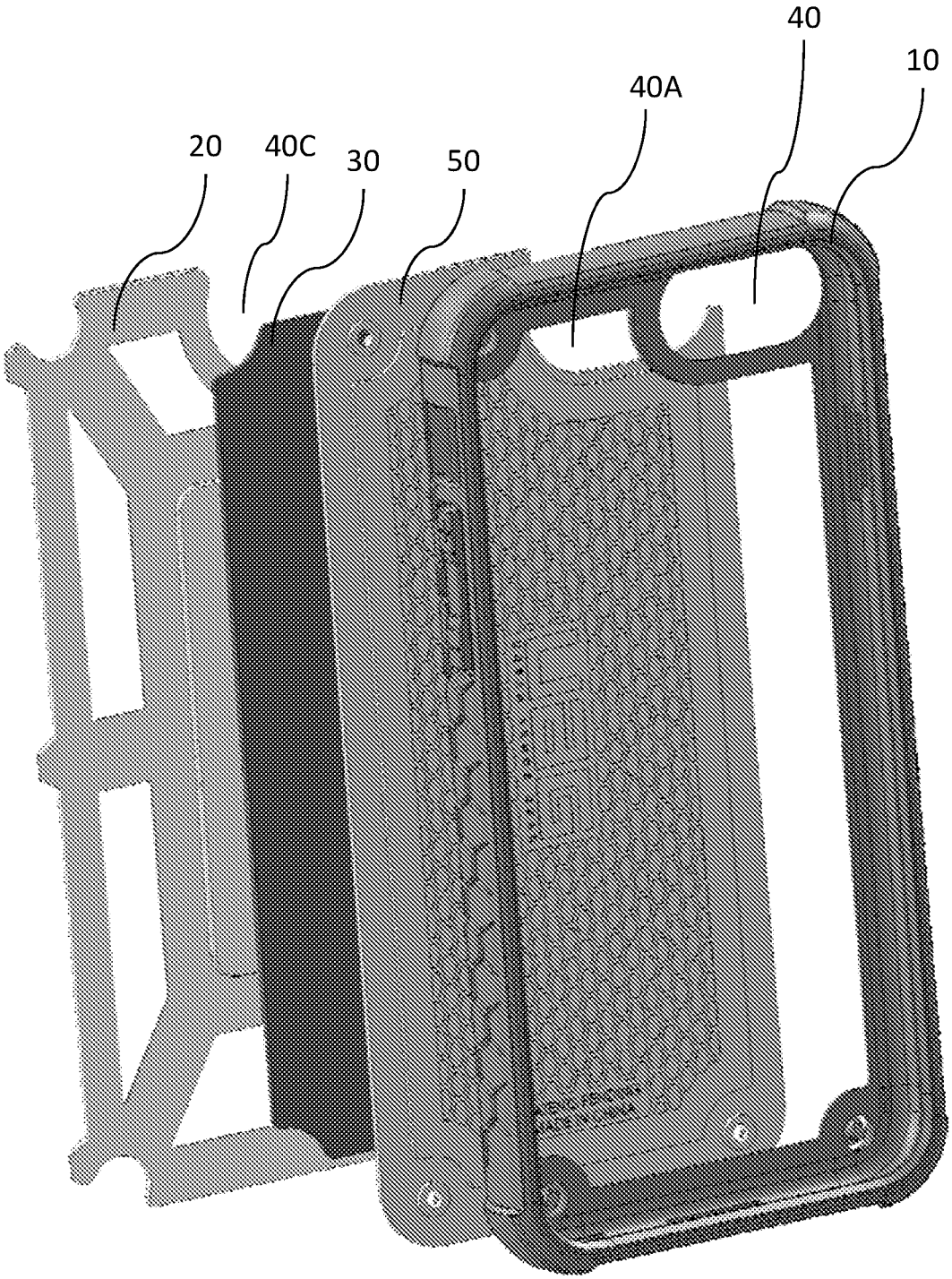
FIG. 5 depicts another exploded view of another embodiment of a case.

FIG. 5 provides an internal cradle-facing perspective view of the exploded case of FIG. 4. Briefly, as noted, the shear plate (50) is the portion of the base of the cradle that faces the electronic device (not pictured). This shear plate (50) may include patterns or coatings that enhance grip, protection, or aesthetics such as a honeycomb pattern. The portion the shear plate, or aspect of this portion, adjacent to or touching the electronic device (i.e., on the base within the cradle) may be comprised of a material that is different than the substantially rigid material forming the shear plate. This material may have a different modulus of elasticity than the primary structural material of the shear plate (50). In certain embodiments, a pattern is formed in this portion of the shear plate (50) in the primary structural material of the shear plate (50).

With regard to the embodiment depicted in FIGS. 2-5, a multi-layer (or sandwiched) configuration is depicted. In the depicted embodiments a shear plate (50) is generally included that comprises a material having rigid characteristics such as a substantially rigid material, a material formed to be rigid, a material that is resistant to deformation or bending. Materials comprising this shear plate may vary, including composite material or polycarbonate, among other materials. Material that is generally more compliant, softer, or less rigid such as rubber (e.g., TPU), is often overmolded over the substantially rigid shear plate. This interconnected wall material may (but not necessarily or exclusively) often include a pattern such as a hexagonal, lines, grooves and notches, or other pattern in orientation facing away from the cradle opening such that it is exposed when the electronic device is housed within the cradle. This or similar features, for example, enhance gripping features or gripability of the case along one or more perimetral edges. The rubber adheres and bonds to the shear plate. The overmolded material is identified in the interconnected walls (10). While the A backing layer (30) is then applied, which may comprise a still different material, e.g., leather, wood, carbon fiber, etc. A frame 20 is them applied. The frame may comprise a hard plastic or composite material and be provided in a variety of configurations such as the X shaped (or generally star shaped, such as a 6 pronged star or a hub and spoke design (e.g., star) comprised of 3-8 prongs) frame that is depicted. Fasteners may be inserted to the device. The fasteners may be metal or plastic or another material, and may be in the form of a rivet. In certain embodiments, the fastener provides an aesthetic function, rather than a structural function. In other embodiments a fastener may fasten or aid in positioning of one or more elements of the case. In such embodiments, the fastener may aid in fastening the backing material on the shear plate. Also in such embodiments, the fastener may aid in fastening the frame on the backing material or the shear plate. The electronic device is then to be introduced in the cradle formed in the open end opposite the base comprising the frame, backing material, and shear plate. The above generally describes one exemplary layup process, though other steps or alternative steps may be provided such that different components are combined in a different order.

The multiple layers comprised of different materials provide for a case that has multiple novel benefits from both aesthetic and protective perspectives, while minimizing bulk and weight. Each of the different materials have differing shear and impact resistance properties that work in unison in the device. The sandwiched construction packages each of these materials such that impact forces are distributed and dissipated through material interfaces obtained through over molding, adherence, and/or press-fit construction. Though not wishing to be bound by any particular theory of operation, a shock force introduced to the shear plate is dissipated in the plate itself and also through the rubber, backing layer, and the frame to reduce the magnitude of the shock passed onto an electronic device resident in the case.

The definitions of the words or elements of the following claims are, therefore, defined in this specification to not only include the combination of elements which are literally set forth. It is also contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination(s).

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what incorporates the essential idea of the embodiments.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

I claim:

1. A multi-layered composite case for an electronic device, the multi-layered composite case comprising:

an electronic device cradle defined by:

two or more inter-connected walls comprised of a resilient and impact resistant material, and a separate base distinct from and directly connected with the two or more inter-connected walls, the separate base comprising:

a shear plate of substantially rigid material, the shear plate forming at least a first portion of the separate base and having a front surface and an opposing rear surface, wherein a perimetral portion of the front surface of the shear plate is directly connected to the two or more inter-connected walls;

a frame of substantially rigid material directly connected with the shear plate and forming at least a second portion of the separate base which is distinct from the first portion of the separate base; and a backing layer of material having a different rigidity than the shear plate or the frame, the backing layer having a front surface and an opposing rear surface, wherein a perimetral portion of the front surface of the backing layer is spaced apart from the two or more inter-connected walls, the backing layer is positioned between the shear plate and the frame to form a multi-layer sandwich construction and the backing layer forms at least a third portion of the separate base which is distinct from the first portion of the separate base and distinct from the second portion of the separate base, such that the backing layer and at least a portion of the frame are each in direct contact with the rear surface of the shear plate;

wherein the electronic device cradle is adapted to house the electronic device in a predetermined orientation with, when housed, the two or more inter-connected walls being adjacent to and at least partially in contact with at least a portion of a perimetral portion of the electronic device and the front surface of the shear plate of the separate base being adjacent to and at least partially in contact with a back portion of the electronic device.

2. The multi-layered composite case according to claim 1, wherein the two or more inter-connected walls are comprised of less rigid material than at least one of the shear plate and the frame.

3. The multi-layered composite case according to claim 1, wherein the two or more inter-connected walls comprise four walls interconnected at right angles.

4. The multi-layered composite case according to claim 1, wherein the electronic device comprises a screen portion, the back portion, and the perimetral portions, wherein the screen portion and the back portion are situated on opposite sides of the electronic device.

5. The multi-layered composite case according to claim 1, wherein the shear plate and the frame comprise the same substantially rigid material.

6. The multi-layered composite case according to claim 1, wherein the shear plate and the frame comprise substantially rigid materials having different rigidities.

7. The multi-layered composite case according to claim 1, wherein the backing layer comprises a material having a different rigidity than the resilient and impact resistant material of the two or more inter-connected walls.

8. The multi-layered composite case according to claim 1, wherein the two or more inter-connected walls, the shear plate, and the backing material comprise different materials having at least one of: different rigidities, different resiliencies, and different impact resistances.

9. The multi-layered composite case according to claim 1, wherein the two or more inter-connected walls, the shear plate, the frame, and the backing material comprise different materials having at least one of: different rigidities, different resiliencies, and different impact resistances.

10. The multi-layered composite case according to claim 1, wherein when the electronic device is housed in the electronic device cradle, at least one of the backing material, the frame, and the shear plate wraps at least partially around the perimetral portion of the electronic device.

11. The multi-layered composite case according to claim 1, wherein when the electronic device is housed in the electronic device cradle, the two or more inter-connected walls wrap at least partially around the perimetral portion of the electronic device.

12. The multi-layered composite case according to claim 1, wherein when the electronic device is housed in the electronic device cradle, at least one of the two or more inter-connected walls defines an opening to access at least one of a port, a button, a dock, a lever, a knob, a speaker, and an opening on the electronic device.

13. The multi-layered composite case according to claim 1, wherein the substantially rigid material comprises a thermoset polymer.

14. The multi-layered composite case according to claim 1, wherein the substantially rigid material comprises a thermoplastic polymer comprising polycarbonate plastic.

15. The multi-layered composite case according to claim 1, wherein the shear plate, the backing material, and the frame are fit together in a structural mating geometry comprising at least one of a first indentation, a groove, an independent member, and a raised portion of at least one of the shear plate and the backing material adapted to mate with a corresponding structure on the frame.

16. The multi-layered composite case according to claim 1, wherein the shear plate, the backing material, and the frame are fit together in a structural mating geometry comprising at least one of a first indentation, a groove, an independent member, and a raised portion of the shear plate adapted to mate with a corresponding structure on at least one of the backing material and the frame.

17. The multi-layered composite case according to claim 1, wherein the shear plate, the backing material, and the frame are fit together in a structural mating geometry comprising at least one of a first indentation, a groove, an independent member, and a raised portion on at least one of the shear plate and the frame adapted to mate with a corresponding structure on the backing material.

18. The multi-layered composite case according to claim 1, wherein the two or more inter-connected walls and the shear plate are fit together in a structural mating geometry.

19. The multi-layered composite case according to claim 1, wherein the two or more inter-connected walls and the frame are fit together in a structural mating geometry.

20. The multi-layered composite case according to claim 1, wherein the two or more inter-connected walls and the backing material are fit together in a structural mating geometry.

21. The multi-layered composite case according to claim 1, wherein the frame is adapted to cover a periphery region of the shear plate adjacent to the two or more inter-connected walls.

22. The multi-layered composite case according to claim 1, wherein when the electronic device is housed in the electronic device cradle, the electronic device cradle defines an unobstructed opening for an optical device of the electronic device.

23. The multi-layered composite case according to claim 1, wherein the separate base is fit together in a structural mating geometry with the two or more inter-connected walls.

24. The multi-layered composite case according to claim 1, wherein the resilient and impact resistant material comprises thermoplastic polyurethane.

25. The multi-layered composite case according to claim 1, wherein the two or more inter-connected walls, the shear plate, the frame, and the backing material comprise different materials, each having a different modulus of elasticity.

26. The multi-layered composite case according to claim 1, wherein the two or more inter-connected walls comprise thermoplastic polyurethane rubber and the shear plate comprises a polycarbonate.

27. The multi-layered composite case according to claim 1, wherein the two or more inter-connected walls comprise thermoplastic polyurethane rubber and the frame comprises a polycarbonate.

28. The multi-layered composite case according to claim 1, wherein the backing material comprises leather.

29. The multi-layered composite case according to claim 1, wherein the backing material comprises at least one of wood, wood pulp, and wood fiber.

30. The multi-layered composite case according to claim 1, wherein the backing material comprises carbon fiber.

31. The multi-layered composite case according to claim 1, wherein the backing material comprises at least one of a woven fabric and a non-woven fabric.

32. A method of assembling a multi-layered composite case, the method comprising:

connecting two or more inter-connected walls comprised of a resilient and impact resistant material with a shear plate of substantially rigid material, the shear plate forming at least a first portion of a base separate from and operably connectable with the two or more inter-connected walls to define an electronic device cradle configured to house an electronic device in a predetermined orientation with, when housed, the two or more inter-connected walls being adjacent to and at least partially in contact with at least a portion of a perimetral portion of the electronic device and a front surface of the shear plate of the base being adjacent to and at least partially in contact with a back portion of the electronic device, wherein the shear plate has the front surface and an opposing rear surface, and wherein a perimetral portion of the front surface of the shear plate is directly connectable to the two or more inter-connected walls;

arranging a backing material between the shear plate and a frame, the frame being of substantially rigid material and forming at least a second portion of the base which is distinct from the first portion of the base, and the backing material having a different rigidity than the shear plate or the frame and forming at least a third portion of the base which is distinct from the first portion of the base and distinct from the second portion of the base, wherein the backing material has a front surface and an opposing rear surface, and a perimetral portion of the front surface of the backing material is spaced apart from the two or more inter-connected walls, and assembling the frame with the two or more inter-connected walls or shear plate to form a multi-layer sandwich construction between at least the shear plate, the backing material, and the frame such that the backing material and at least a portion of the frame are each in direct contact with the rear surface of the shear plate.

* * * * *